United States Patent [19]

Kornatowski

[11] 4,418,809

[45] Dec. 6, 1983

[54] COMBINATION HANDWHEEL AND HANDWHEEL CLUTCH FOR SEWING MACHINES

[75] Inventor: Boleslaw Kornatowski, Elizabeth, N.J.

[73] Assignee: The Singer Company, Stamford, Conn.

[21] Appl. No.: 319,828

[22] Filed: Nov. 9, 1981

[51] Int. Cl.[3] ..... F16D 11/00; F16D 13/60; D05B 59/00

[52] U.S. Cl. ..... 192/67 R; 192/114 R; 112/279; 242/20; 74/531

[58] Field of Search ..... 192/67 R, 89 QT, 114 R; 112/279; 242/20, 21, 22, 23, 24; 74/531

[56] References Cited

U.S. PATENT DOCUMENTS

| | | | |
|---|---|---|---|
| 1,953,179 | 4/1934 | Kingston | 192/114 R X |
| 2,374,542 | 4/1945 | Hausman | 192/67 R |
| 3,353,640 | 11/1967 | Leslie | 192/67 R |
| 4,038,508 | 7/1977 | Maplesden | 74/531 X |
| 4,091,755 | 5/1978 | Ishikawa et al. | 112/279 |
| 4,096,812 | 6/1978 | Gegauf | 242/22 X |

FOREIGN PATENT DOCUMENTS

| | | | |
|---|---|---|---|
| 52-45396 | 10/1977 | Japan . | |
| 13421 | of 1906 | United Kingdom | 74/531 |

*Primary Examiner*—Rodney H. Bonck
*Assistant Examiner*—David D. House
*Attorney, Agent, or Firm*—William V. Ebs; Robert E. Smith; Edward L. Bell

[57] ABSTRACT

A handwheel and handwheel clutch assembly for a sewing machine having a bistable tiltable element for engaging or disengaging the clutch thereby coupling or decoupling the handwheel from the arm shaft.

5 Claims, 6 Drawing Figures

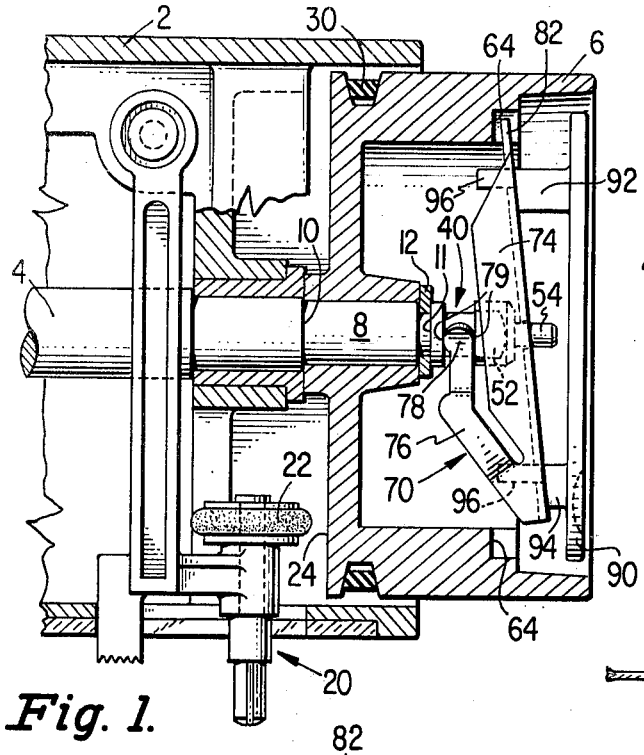
Fig. 1.
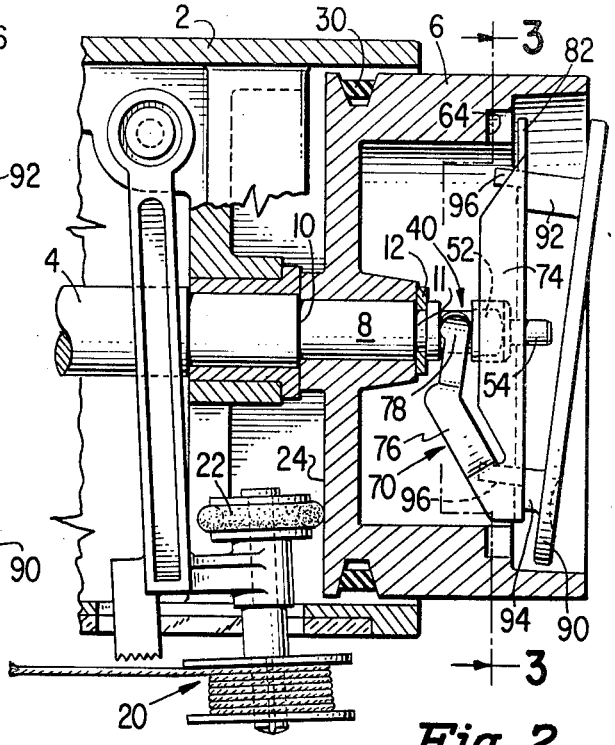
Fig. 2.
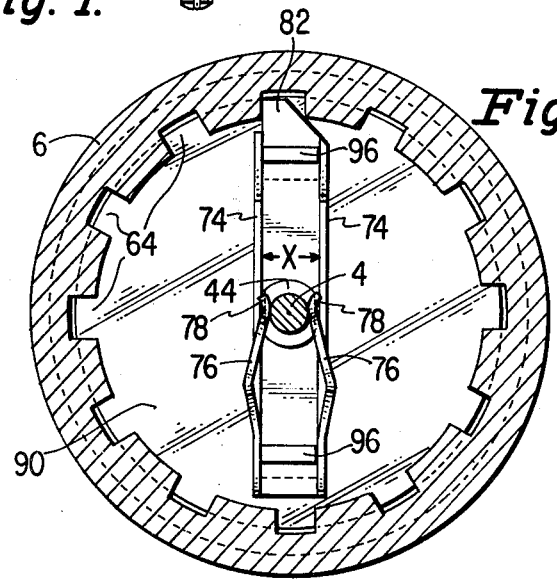
Fig. 3.
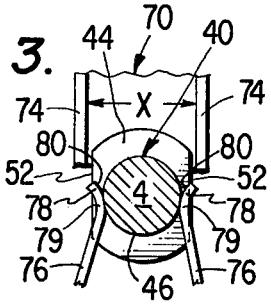
Fig. 4.
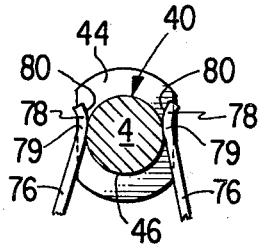
Fig. 5.
Fig. 6.
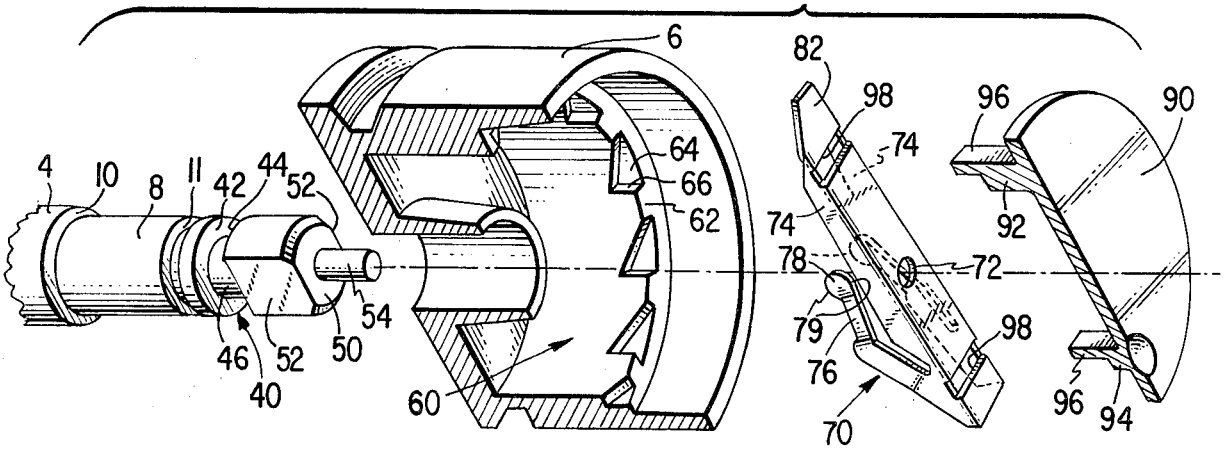

COMBINATION HANDWHEEL AND HANDWHEEL CLUTCH FOR SEWING MACHINES

DESCRIPTION

BACKGROUND OF THE INVENTION

This invention relates to combination handwheels and handwheel clutches for sewing machines and, more particularly, to a handwheel clutch that may be decoupled from the arm shaft of a sewing machine by light manual pressure on a tiltable member associated with the handwheel. In a typical sewing machine, a handwheel is provided which is rotated by a drive belt coupled to an electric drive motor. The handwheel is coupled to the arm shaft by a clutching device. In many instances, a bobbin winder is provided which is driven by frictional contact with the handwheel. Since the arm shaft drives all of the other mechanisms in the sewing machine it is desirable to declutch the handwheel from the arm shaft when winding thread on a bobbin. Present handwheel clutches tend to detract from the aesthetic appearance of the sewing machine and are frequently composed of many parts resulting in a complex and costly mechanism.

It is therefore an object of this invention to provide a handwheel declutching mechanism wholly contained within the interior of the handwheel to preserve the aesthetic appearance of the sewing machine.

It is another object of this invention to provide a handwheel declutching mechanism of simple construction, few parts, and relatively inexpensive to manufacture and maintain.

Other objects and advantages of the invention will become apparent through reference to the accompanying drawings and descriptive matter which illustrate a preferred embodiment of this invention.

SUMMARY OF THE INVENTION

According to the present invention, there is provided a sewing machine having an arm shaft, a handwheel, and a drive means for rotating the handwheel. A clutch means is provided for drivingly coupling the handwheel to the arm shaft. The clutch means comprises a drive notch formed in the handwheel and a driving element supported on the arm shaft for rotation therewith. The driving element is arranged to tilt between each of two bistable positions. When in the first of the bistable positions, the driving element is in driving engagement with the drive notch and when in the second of the bistable positions, the driving element is not in driving engagement with the drive notch. The driving element comprises an elongated portion having a centrally located discontinuity for tiltably engaging the end of the arm shaft. There is a pair of opposing leaf springs arranged adjacent to and on either side of the discontinuity. These opposing leaf springs are arranged to interferingly engage the arm shaft on either side of center thereby retaining the driving element in either of the two bistable positions.

BRIEF DESCRIPTION OF THE DRAWINGS

In order that the invention be more fully understood, it will now be described, by way of example, with reference to the following drawings in which:

FIG. 1 is a cross sectional view of the handwheel and handwheel clutch assembly of the sewing machine illustrating a preferred embodiment of the invention;

FIG. 2 is a cross sectional view similar to that of FIG. 1;

FIG. 3 is a cross sectional view taken along the line 3—3 of FIG. 2;

FIG. 4 is a partial view of FIG. 3 with the handwheel clutch engaged;

FIG. 5 is similar to FIG. 4 with the handwheel clutch disengaged; and

FIG. 6 is an exploded perspective view showing the handwheel and clutch components of the present invention.

DESCRIPTION OF THE PREFERRED EMBODIMENT

Referring to FIGS. 1 through 6, there is shown a sewing machine 2 having an arm shaft 4 with a handwheel 6 rotationally supported thereon. The handwheel 6 is free to rotate on the diameter 8 of the arm shaft 4 and is retained between the shoulder 10 and the snap ring 12. A bobbin winder mechanism shown generally at 20 is of conventional construction having a friction wheel 22 which may be placed in frictional engagement with the surface 24 of the handwheel 6 for rotational driving thereby. During the normal sewing operation, the friction wheel 22 is out of engagement with the surface 24 as shown in FIG. 1. A drive belt 30 rotationally couples the handwheel 6 to a drive motor, not shown.

Referring to FIG. 6, there is shown an exploded perspective view of the component parts comprising the handwheel clutch assembly. An annular groove 40 is formed in the arm shaft 4 adjacent the snap ring groove 11. The annular groove 40 has a base diameter portion 46, a left side wall or annular surface 42, and a right side wall or annular surface 44 which is parallel to the left side wall 42. The end 50 of the arm shaft 4 has two diametrically opposite and substantially parallel flats 52 formed thereon and a cylindrical projection 54 at the very tip. The handwheel 6 has a hollow interior 60 and a shoulder 62 formed on the inner wall thereof. A series of drive notches 64 are equally spaced about the shoulder 62 each having a drive surface 66 that is substantially parallel to the axis of the arm shaft 4. A driving element generally shown at 70 has a central perforation 72 sized to loosely slip over the cylindrical projection 54. The driving element 70 is of U-shaped cross section having parallel side walls 74. The distance X between the inner surfaces of the two side walls 74, as shown in FIGS. 3 and 4, is selected so that these inner surfaces will slidingly engage the pair of flats 52 of the arm shaft 4. Thus, with the inner surfaces of the side walls 74 in engagement with the pair of flats 52, the driving element 70 is rotationally coupled to the arm shaft 4. The central perforation 72 loosely engages the cylindrical projection 54 so that the driving element 70 may tilt with respect to the arm shaft 4 while still retaining its rotational couple thereto.

A pair of leaf springs 76, each having a resilient portion, are formed in the side walls 74 of the driving element 70. Each leaf spring 76 has a contact end 78 with a spherical surface 80, shown in FIGS. 4 and 5. The two spherical surfaces 80 are diametrically opposite each other and slightly past center of the central perforation 72 in a direction toward the end 82 of the driving element 70. The two spherical surfaces 80 are spaced apart so that they will frictionally engage the diameter 46 as shown in FIGS. 4 and 5 while the contact ends 78 are dimensioned so that the edges 79 will loosely engage the left side wall 42 and the right side wall 44 of the annular groove 40 as shown in FIG. 1. The frictional engagement between the two spherical surfaces 80 and the diameter 46 provides a biasing force tending to maintain the driving element in either of two stable positions. One position as shown in FIGS. 1 and 4 and the other stable position as shown in FIGS. 2 and 5. An actuating plate 90 made of a suitable plastic material, has molded therein a long boss 92 and a short boss 94. Each boss has a molded extension 96 which lockingly engages a pair of mounting slots 98 formed in the driving element 70. This actuating plate 90 is included in the interest of operator safety and is not necessary for the successful practice of this invention. As can be seen in FIG. 1, the length of the bosses 92 and 94 are such that the actuating plate 90 is substantially square with respect to the handwheel 6 when the end 82 of the driving element 70 has engaged the drive notch 64. This is its normal position when sewing.

In operation, the operator will depress the actuating plate 90, tilting it into its second bistable position, as shown in FIG. 2, wherein the end 82 is out of engagement with the drive notch 64 thereby rotationally decoupling the handwheel 6 from the arm shaft 4. With the driving element 70 in this position the friction wheel 22 of the bobbin winder 20 may be engaged with the surface 24 of the handwheel 6 for winding the bobbin without effecting rotation of the arm shaft. When the winding operation is completed the bobbin winder 20 is disengaged from the surface 24 and the actuating plate 90 is returned to its first bistable position.

As can be seen, the driving element 70 is of unitary construction thereby providing a unique and extremely simple clutch structure. With this arrangement the component parts are economical to manufacture and extremely simple to assemble. The important and unique features of this invention are manifested in the bistable driving element having leaf springs which engage the arm shaft for retaining purposes and for biasing the driving element in either of the two bistable positions.

Upon reviewing the present disclosure a number of alternative constructions will occur to one skilled in the art. Such constructions may utilize variations in the driving element 70 such as a single leaf spring 76 or variations in other components of the present invention. These constructions however are considered to be within the spirit and scope of this invention.

I claim:

1. In a sewing machine having an arm shaft, a handwheel, and a drive means for rotating said hand wheel, a clutch means for drivingly coupling said handwheel to said arm shaft comprising:

a. a drive notch formed in said handwheel and b. a driving element supported on said arm shaft for rotation therewith and arranged to tilt between each of two bistable positions, when in the first of said bistable positions said driving element is in driving engagement with said drive notch and when in the second of said bistable positions said driving element is not in driving engagement with said drive notch, wherein said driving element comprises an elongated portion having a centrally located discontinuity for tiltably engaging the end of said arm shaft and a leaf spring arranged adjacent to and on one side of said discontinuity to interferingly engage said arm shaft, the arm shaft including a flat surface parallel to the axis thereof, and the driving element including a side wall which is arranged to loosely contact the arm shaft to thereby effect a rotational couple between the arm shaft and said driving element.

2. The combination of claim 1 wherein said end of said arm shaft includes a cylindrical projection, and said centrally located discontinuity comprises a perforation which loosely embraces said cylindrical projection.

3. The combination of claim 2 wherein said arm shaft includes an annular groove formed therein, said groove having a base diameter and two parallel annular surfaces extending radially outwardly from said base diameter, and wherein said leaf spring has a free end which interferingly engages a tangent point on said base diameter so that said free end is urged in a direction away from said tangent point thereby effecting either of said two bistable positions, said free end being loosely contained between said two annular surfaces thereby restraining axial movement of said driving element with respect to said arm shaft.

4. The combination of claim 3 wherein said leaf spring includes a resilient portion for urging said free end into pressing contact with said base diameter.

5. In a sewing machine having an arm shaft, a handwheel, and a drive means for rotating said handwheel, a clutch means for drivingly coupling said handwheel to said arm shaft comprising:

a. a drive notch formed in said handwheel and b. a driving element supported on said arm shaft for rotation therewith and arranged to tilt between each of two bistable positions, when in the first of said bistable positions said driving element is in driving engagement with said drive notch and when in the second of said bistable positions said driving element is not in driving engagement with said drive notch, wherein said driving element comprises an elongated portion having a centrally located discontinuity for tiltably engaging the end of said arm shaft, a leaf spring arranged adjacent to and on one side of said discontinuity to interferingly engage the arm shaft, and a second leaf spring arranged in opposition to the first mentioned leaf spring to interferingly engage said arm shaft on the opposite side of the discontinuity.

* * * * *